United States Patent [19]

Amagaya

[11] Patent Number: 4,779,785

[45] Date of Patent: Oct. 25, 1988

[54] PORTABLE STATIONERY DEVICE

[75] Inventor: Hidefumi Amagaya, Tokyo, Japan

[73] Assignee: Plus Corporation, Tokyo, Japan

[21] Appl. No.: 31,702

[22] Filed: Mar. 30, 1987

[30] Foreign Application Priority Data

Oct. 14, 1986 [JP] Japan ..... 61-156952[U]
Nov. 6, 1986 [JP] Japan ..... 61-170700[U]

[51] Int. Cl.[4] ..... B25C 1/02
[52] U.S. Cl. ..... 227/76; 83/618
[58] Field of Search ..... 227/76, 78; 83/618

[56] References Cited

U.S. PATENT DOCUMENTS 4,002,281 1/1977 Hsu ..... 227/76
4,114,793 9/1978 Hsu ..... 227/76
4,288,018 9/1981 Taniguchi ..... 227/76
4,491,261 1/1985 Mitsuhashi ..... 227/76
4,640,451 2/1987 Steiner et al. ..... 227/76

*Primary Examiner*—E. R. Kazenske
*Assistant Examiner*—James L. Wolfe
*Attorney, Agent, or Firm*—McAulay, Fields, Fisher, Goldstein & Nissen

[57] ABSTRACT

A portable stationery device having a punching device disposed in a lower portion of a holder and a stapler disposed in an upper portion of the holder above the punching device. The stapler can be freely drawn out from or retracted into the holder. When the punching device is used to punch a sheet of paper a punching rod of the punching device is pressed by the stapler.

7 Claims, 4 Drawing Sheets

PORTABLE STATIONERY DEVICE

BACKGROUND OF THE INVENTION

This invention relates to a portable stationery device used to effect a preliminary task in the arrangement and filing of office papers in which the papers are to be bound with staples or punched for filing in a binder.

Traditionally, staplers are used to bind papers with staples, and punches are used to punch holes for binding papers in binders or the like. Since a stapler and a punch are ordinarily provided as separate devices, they must always be ready use when required and are therefore inconvenient in terms of portability and handling.

SUMMARY OF THE INVENTION

It is therefore an object of the present invention to provide a portable stationery device which is useful in being capable of application to the functions of both a stapler and a punch, as well as being convenient when being carried, and the present invention provides a portable stationery device which has a holder incorporating a stapler and a punching device in such a manner that both of these devices can be used selectively.

BRIEF DESCRIPTION OF THE DRAWINGS

The accompanying drawings show a portable stationery device which represents an embodiment of the present invention.

DETAILED DESCRIPTION OF THE PREFERRED EMBODIMENT

Figure 1:
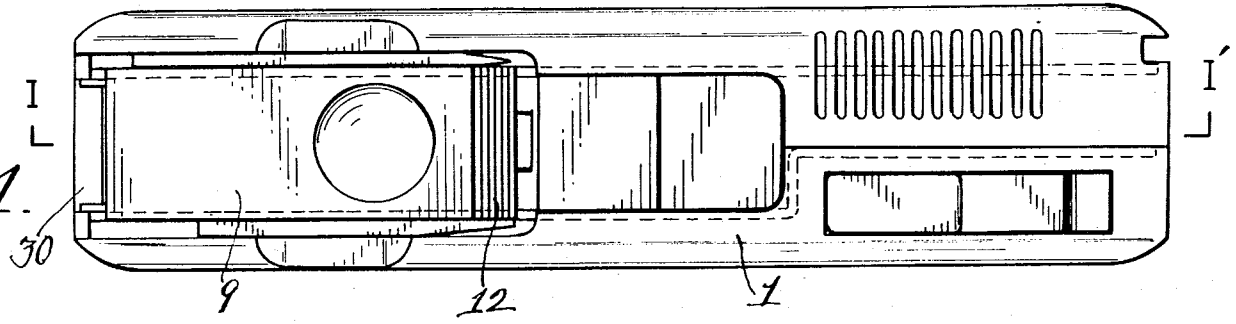
FIG. 1 is a plan view of the portable stationery.
Figure 2:
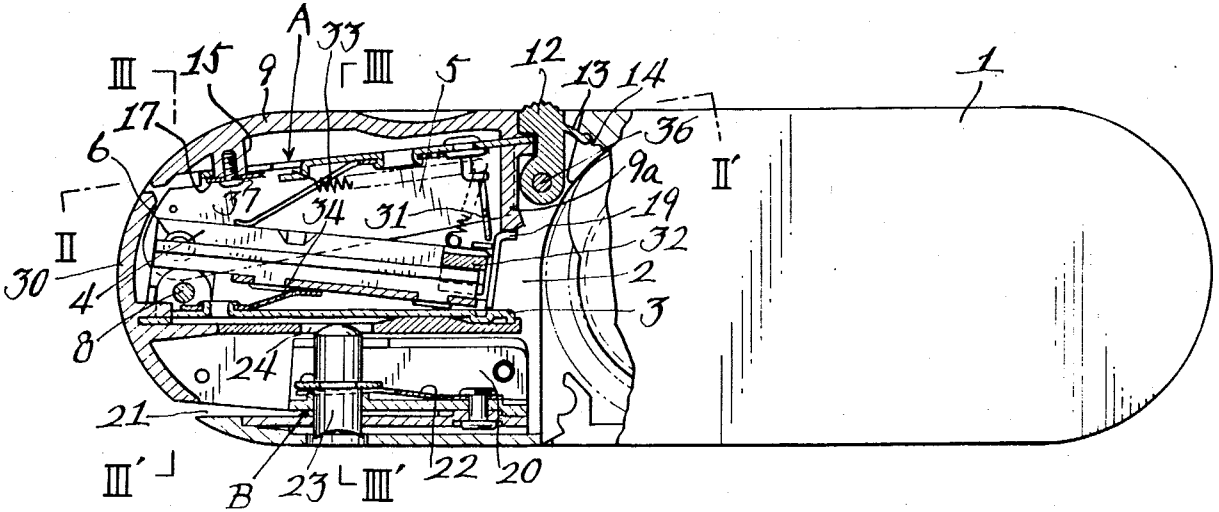
FIG. 2 is a partially cutaway cross-sectional view taken along the line I—I' of FIG. 1.
Figure 3:
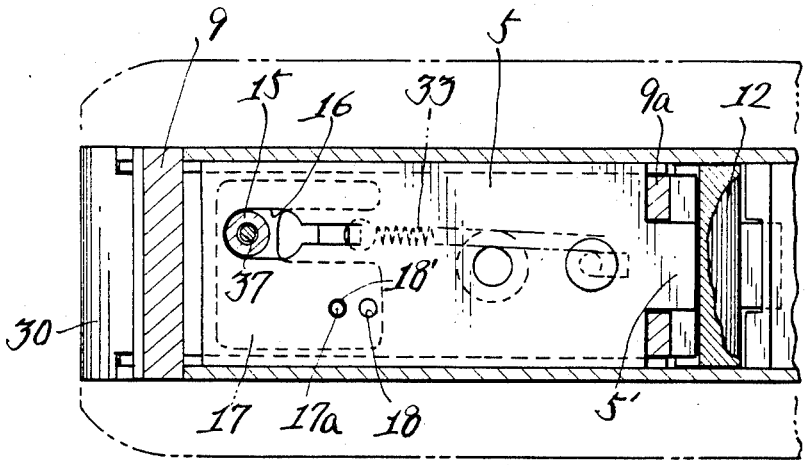
FIG. 3 is a cross-sectional view taken along the line II—II' of FIG. 2.
Figure 4:
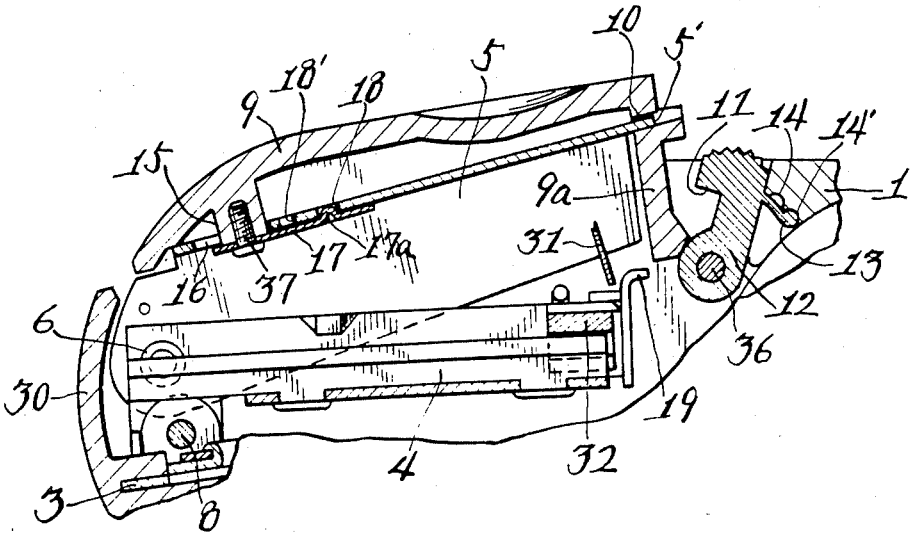
FIG. 4 is a cross-sectional view of FIG. 3.
Figure 5:
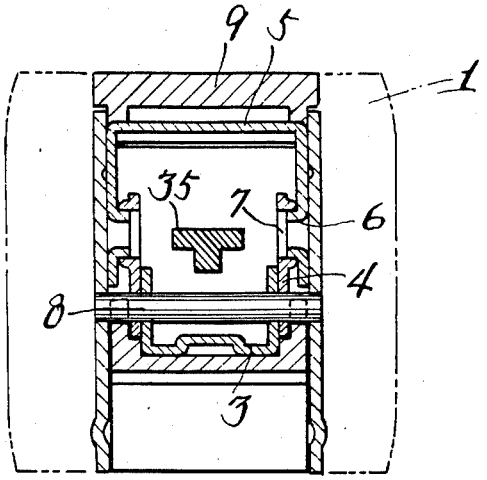
FIG. 5 is a cross-sectional view taken along the line III—III' of FIG. 2.
Figure 6:
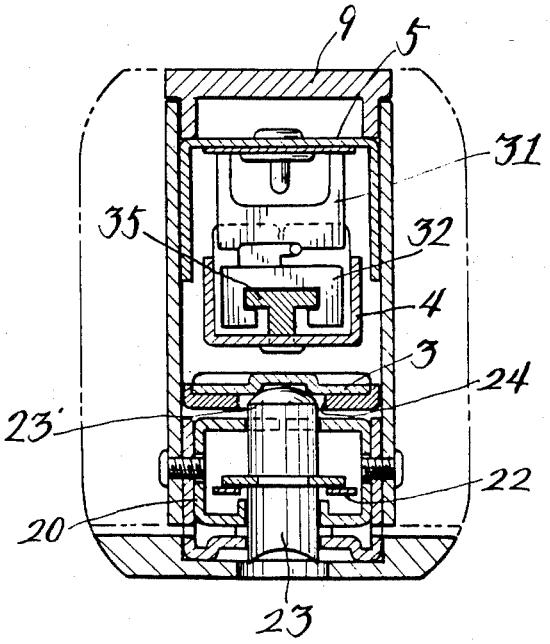
FIG. 6 is a cross-sectional view taken along the line of IV—IV' of FIG. 2.
Figure 7:
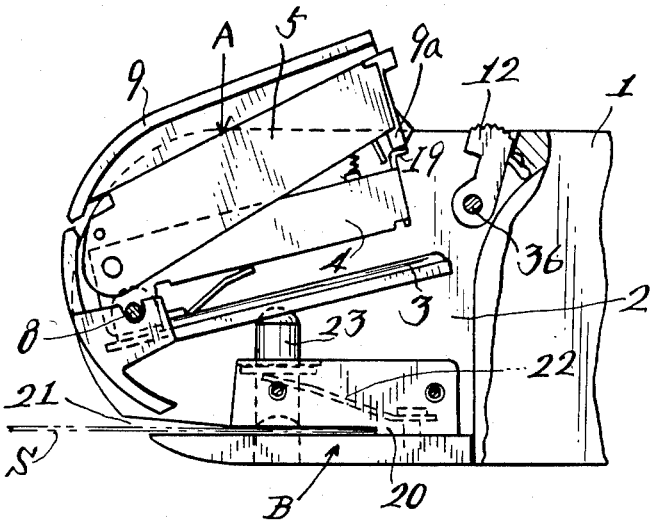
FIG. 7 is a side view of the portable stationery device shown while a punching device is being used.
Figure 8:
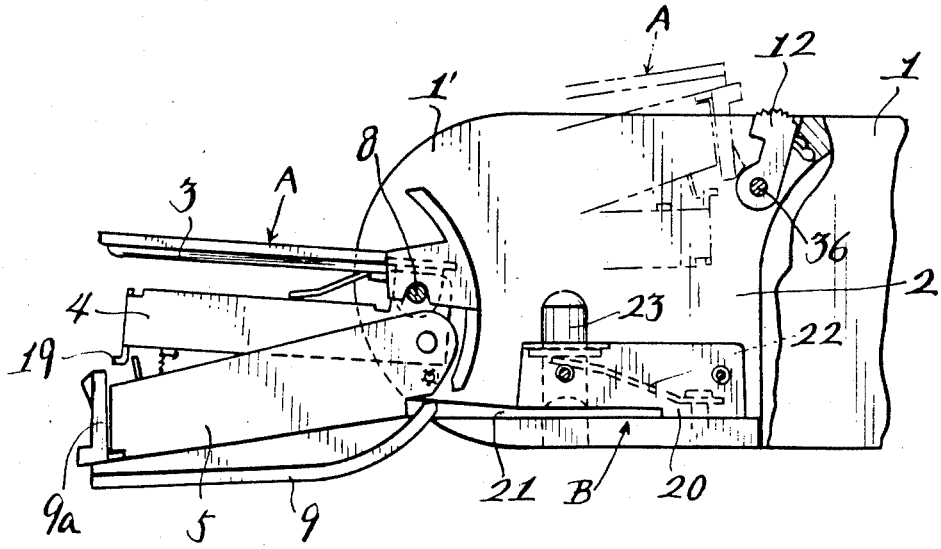
FIG. 8 is a side view of the portable stationery device shown while a stapler is being used.

The present invention will be described below in detail with reference to the accompanying drawings which show a portable stationery device which represents an embodiment of the present invention.

A stapler A is fitted into an accommodation gap 2 which is formed in an upper part of a holder 1 such as to be capable of being drawn out and retracted and which is provided with a staple receiving frame 3, staple accommodation frame 4 and operation frame 5. These frames are supported at the root portion of the stapler such as to be pivotable relative to each other. A flange 6 provided at the root portion of the operation frame 5 is engaged with a connection hole 7 formed in the staple accommodation frame 4 so that the members 4 and 5 are pivotally supported one on the other, and the staple accommodation frame 4 and the staple receiving frame 3 are pivotally supported by a support shaft 8 laterally disposed in the accommodation gap 2 of the holder 1. These members are thus assembled to be capable of being drawn out from and retracted into the holder 1.

A operation piece 9 which has an extension 9*a* downwardly extending from the top end of the operation piece 9 is disposed outside of the operation frame 5 of the stapler A. A though hole 10 is formed in the base portion of the extension 9*a* of the operation piece 9. A locking piece 12 having an engaging surface 11 which is engaged with an end 5 of the operation frame 5 passing through the through hole 10 is pivotally supported by a pin 36 on the holder 1. A locking piece projection 13 formed on the locking piece 12 at the opposite side thereof relative to the engaging surface 11 is engaged with one of outer and inner engaging recesses 14 and 14' formed in the body of the holder 1, thereby enabling the stapler A to be maintained in the accommodation gap 2 of the stapler A or released from the same.

A projection 15 is formed on the inner surface of the operation piece 9 at the other end thereof near the root portion of the stapler and is engaged with an hole 16 which is formed in the operation frame 5 such as to be elongated in the longitudinal direction of the stapler. A plate spring 17 is attached at its one end to the lower surface of the projection 15 by a screw 37, and the plate spring 17 has a raised portion 17*a* formed at the other end nearer to the top of the stapler. A pair of fore and rear through holes 18 and 18' engagable with the raised portion 17*a* are formed in the operation frame 5, so that the raised portion 17*a* is engaged with the forward through hole 18 when the operation piece 9 is moved along the operation frame 5 toward the top of the stapler and that it is engaged with the rear through hole 18' when the operation piece 9 retreats, thereby maintaining the advanced or retreated position of the operation piece 9 on the operation frame 5.

A receiving piece 19 which is formed at the top of the staple accommodation frame 4 such as to project in the longitudinal direction thereof is disposed below the extension 9*a* of the operation frame 9 in the retreated position.

A punching device B is disposed in the lower portion of the holder or in the innermost part of the accommodation gap 2. The punching device B has a base frame 20. The base frame 20 has a gap 21' corresponding to a gap 21 which is formed in a side wall 1' of the holder and into which a sheet of paper to be punched is inserted and which. The base frame 20 also has a punching rod 23 which is constantly urged by a spring 22 in the upward direction and which perpendicularly moves across the gap 21'. The top end 23' of the punching rod 23 project into the accommodation gap 2 by the urging force of the spring 22.

The punching rod 23 projecting into the accommodation gap 2 is engaged with a hole 24 formed in an intermediate portion of the staple receiving frame 3 of the stapler A when the stapler A is accommodated in the accommodation gap 2, thereby limiting the projection of the punching rod 23.

A cover piece 30 which is attached to the staple receiving frame 3 serves as a member for improving the appearance of the holder when the stapler A is accommodated in the accommodation gap 2.

A staple pressing plate 31 is disposed in the operation frame 5 in such a manner that it does not press any staple accommodated in the staple accommodation frame 4 when the operation piece extension 9*a* is received by the receiving piece 19 (when the operation piece 9 is in the retracted position on the operation frame 5), or that the staple pressing plate 31 does not contact any staple when the extension 9*a* is brought into contact with the receiving piece 19 by turning the operation frame 5 or the operation piece 9. To achieve this relationship, the length of the extension 9*a* may be increased in relation to the length of the staple pressing plate 31, or the position of the receiving piece 19 may be set to be higher than that of the staples accommodated.

A supplying piece 32 for supplying staples is urged by a spring 33 toward the top of the staple accommodation frame 4. A returning spring 34 is stretched between the staple accommodation frame 4 and the staple receiving frame 3.

When, in the device thus constructed, the locking piece 12 is turned so as to engage the engaging projection 13 with the inner engaging recess 14', the end of the operation frame 5 is released from the engaging surface 11 of the locking piece 12. In this state, the punching rod 23 is moved upwardly by the spring 22, thereby pushing all of the members of the stapler A and position the same at the opening of the gap 21'. A sheet of paper S to be punched is thereafter inserted into the insertion gap 21, and the operation frame 9 is pressed so that the extension 9*a* presses down the the receiving piece 19; the staple accommodation frame 4 presses down the staple receiving frame 3; and the punching rod 23 is pressed by the staple receiving frame 3 at a portion around the hole 24, thereby punching the sheet S.

If the stapler A is turned about the support shaft 8 and the operation piece 9 is thereafter advanced along the operation frame 5, the operation piece extension 9 is displaced from the position right above the receiving piece 19. If at this time the operation piece 9 is pressed, the staple pressing plate 31 presses down one of the staples, thereby effecting binding operation of the stapler in an ordinary manner.

However, if the stapler is turned about the support shaft 8 to the dead point, the root end of the operation piece 9 hits or contacts the opening end of the insertion gap 21 so that, the operation piece 9 advances, in a manner of speaking, automatically along the operation frame 5, thereby enabling binding operation.

The stapler is also provided with a staple mount piece 35 disposed in the staple accommodation frame 4.

According to the present invention, as described above, a stapler and a punching device are accommodated in a holder. Therefore they are convenient when being carried. Also it is possible to effect punching operation by pressing down the all members of the stapler, thereby minimizing the number of components. Since stapler can be used after being turned about the support shaft to project from the accommodation gap, the punching device does not obstruct the binding operation. The present invention thus realizes a useful portable stationery device.

What is claimed is:

1. A holder having an opening therein, a punching device disposed in a lower portion of said holder below said opening, said punching device including a movable punch, and biasing means for biasing said punch to an inoperative position whereby said punch projects into said opening, and a stapler disposed in an upper portion of said holder and movable into and out of said opening, said stapler having punch operating means for moving said punch to an operative position when said stapler is moved into said opening.

2. A portable stationery device according to claim 1, further comprising an accommodation gap formed in said holder, wherein said punching device is disposed in a lower part of said accommodation gap and said stapler is disposed in an upper part of said accommodation gap.

3. A portable stationery device according to either claims 1 or 2, wherein said stapler is composed of three members: a staple receiving frame, a staple accommodation frame and a operation frame.

4. A portable stationery device according to either claims 2 or 3, wherein said punch comprises a punching rod movable generally perpendicularly to the longitudinal direction of said stapler, the top of said punching rod projecting into said accommodation gap, and said punching rod punching a sheet of paper when said stapler is pressed down.

5. A portable stationery device comprising: a holder; an accommodation gap formed in an upper portion of said holder; a punching device disposed in a lower portion of said holder and having a punching rod vertically movable, the top of said punching device projecting into said accommodation gap by the force of a spring provided in said punching device; a stapler fitted into said accommodation gap and capable of being drawn out and retracted, said stapler being pivotally supported at its root portion by a support shaft laterally disposed in said holder, said stapler having a staple receiving frame, a staple accommodation frame and an operation frame, said frames being pivotally supported on said stapler, an intermediate portion of said staple receiving frame of said stapler being positioned right above said punching rod; an operation piece having at its top an extension downwardly extending, said operation piece being attached to the outside of said operation frame such as to be movable in the longitudinal direction of said stapler; and a receiving piece disposed below the position assumed by said extension of said operation piece when said operation piece is in the retreated position nearer to the root portion of said stapler, said receiving piece being formed on the top of said staple accomodation frame such as to outwardly project in the longitudinal direction thereof.

6. A portable stationery device according to claim 5, further comprising: a projection downwardly extending from a root portion of said operation piece and having a lower surface, said projection engaging with a hole formed in said operation frame such as to elongate in the longitudinal direction thereof; and a plate spring whose one end of said plate spring nearer to said root portion of said stapler is attached to the lower surface of said projection, said plate spring having a raised portion formed at the other end, said operation frame having a pair of through holes which are engageable with said raised portion when said operation frame advances of retreats.

7. A portable stationery device according to either claims 5 or 6, further comprising a locking piece pivotally supported on said holder, said locking piece engaging with the top of said operation frame when said stapler in fitted into said accommodation gap.

* * * * *

UNITED STATES PATENT AND TRADEMARK OFFICE

CERTIFICATE OF CORRECTION

PATENT NO. : 4,779,785

DATED : October 25, 1988

INVENTOR(S) : Hidefumi Amagaya

It is certified that error appears in the above—identified patent and that said Letters Patent is hereby corrected as shown below:

Column 3, line 62, after "holder" insert --above said punching device--.

Column 4, lines 8-9, change "either claims 1 or 2" to --claim 1--.

Column 4, lines 12-13, change "either claims 2 or 3" to --claim 2--.

Column 4, line 14, after "rod" insert --having a top and--.

Column 4, line 23, change "the top of said punching device" to --said punching rod having a top--.

Column 4, lines 58-59, change "either claims 5 or 6" to --claim 5--.

Signed and Sealed this

Twenty-fifth Day of April, 1989

*Attest:*

DONALD J. QUIGG

*Attesting Officer*

*Commissioner of Patents and Trademarks*